United States Patent [19]

Liebscher

[11] 4,040,138

[45] Aug. 9, 1977

[54] DRIVE FOR USE IN A SWEEPING DEVICE

[75] Inventor: Johannes Liebscher, Nassau, Lahn, Germany

[73] Assignee: Leifheit International Gunter Leifheit GmbH, Nassau, Lahn, Germany

[21] Appl. No.: 540,822

[22] Filed: Jan. 13, 1975

[30] Foreign Application Priority Data

Jan. 15, 1974 Germany ..... 2401685

[51] Int. Cl.[2] ..... A47L 11/32

[52] U.S. Cl. ..... 15/42

[58] Field of Search ..... 15/42, 46, 49 R, 49 C, 15/79, 22 R, 26, 87

[56] References Cited

U.S. PATENT DOCUMENTS

| | | | |
|---|---|---|---|
| 569,409 | 10/1896 | Courtright et al. | 15/26 |
| 1,318,522 | 10/1919 | Alexander | 15/26 |
| 2,196,667 | 4/1940 | Moseley | 15/22 R |
| 2,197,918 | 4/1940 | Blake | 15/46 |
| 2,782,434 | 2/1957 | Parker et al. | 15/42 X |
| 3,818,532 | 6/1974 | Liefheit et al. | 15/42 |

*Primary Examiner*—Edward L. Roberts
*Attorney, Agent, or Firm*—Michael J. Striker

[57] ABSTRACT

A drive for rotating a corner-sweeping brush of a sweeping device includes a gear on the brush, and a translation member provided with teeth engaging the gear and rotating the same about its axis with attendant rotation of the brush when the housing of the sweeping device comes into contact with an obstruction during its forward movement. An actuating member is connected to the translation member under interposition of a time-delay unit, and moves the translation member into engagement with the gear and subsequently toward an extended position thereof with concomitant rotation of the brush so that dirt is removed from the corner region of the surface being swept, even after the housing of the sweeping device has come to a standstill. The actuating member may be connected to a handle of the sweeping device, or it may be a discrete element projecting forwardly or upwardly out of the housing.

18 Claims, 4 Drawing Figures

DRIVE FOR USE IN A SWEEPING DEVICE

BACKGROUND OF THE INVENTION

The present invention relates to a sweeping device, and more particularly to a drive for use in such a device for driving a corner-sweeping brush which is mounted in the housing of the sweeping device for rotation about an axis.

There are already known various sweeping devices of the type here under discussion, and they are generally used for sweeping floors, carpets or, as the case may be, furniture, upholstery or other surfaces. Such surfaces, more often than not, include corner regions, such as the baseboard regions of a floor where the floor meets with the walls of a room, or similar corner regions next to pieces of furniture or other objects. For the sake of simplicity, the present invention will be described as embodied in a floor-sweeping device, without being restricted thereto.

In such a floor-sweeping device, it is already known to provide a housing which carries a dirt-collecting receptacle and at least one main brush which rotates and which deposits the dirt picked up by it from the floor into the receptacle which is to be periodically emptied. It is also already known to provide a drive for such a brush, such drive being often constituted by wheels mounted in the housing and supporting the same during its movement on the floor, a transmission being interposed between these wheels and the brush, which transmits the rotary movement of the wheels to the brush. All this is well known and not part of the present invention.

In addition thereto, it is also already known to provide at least one corner-sweeping brush in the front region of the housing of the sweeping device, which corner-sweeping brush may be mounted for rotation about a horizontal or about a vertical axis. Such a corner-sweeping brush may be driven in rotation either by the aforementioned wheels, or by means of an additional wheel or wheels which drive only the corner-sweeping brush. An additional dirt-collecting receptacle may be associated with such a corner-sweeping brush, or the dirt picked-up by the same may be deposited into the shared receptacle either directly by the corner-sweeping brush, or indirectly as a result of the dirt being forwarded by the corner-sweeping brush to the main brush which picks it up and deposits it into the receptacle.

A generally satisfactory performance is obtained from such floor-sweeping devices; however, these devices are posssessed of a not insignificant drawback; namely, the rotation of the corner-sweeping brush is dependent on the movement of the wheels which drive the same, and thus on the movement of the sweeping device as a whole. As a consequence thereof, when the floor-sweeping device encounters an obstruction, such as upon coming into contact with the baseboard, a base of a piece of furniture, or a similar part preventing further forward movement of the floor-sweeping device, the wheels which drive the corner-sweeping brush come to a standstill, and so does the corner-sweeping brush. As a result of this, imperfect or wholly unsatisfactory sweeping results are obtained in the corner regions of the surface or floor being swept. This, of course, is very disadvantageous, since it is exactly these corner regions where the dirt tends to accumulate and in which the sweeping action ought to be more pronounced than in other regions of the surface.

SUMMARY OF THE INVENTION

Accordingly, it is an object of the present invention to avoid the disadvantages of the prior-art sweeping devices.

More particularly, it is an object of the present invention to provide a sweeping device of the above-discussed type which is capable of sweeping the corner regions of a surface being swept.

It is a further object of the present invention to devise a drive for rotating the corner-sweeping brush of the sweeping device even after the latter has come to a standstill.

It is still another object of the present invention to provide a time-delayed driver for rotating the corner-sweeping brush.

In pursuance of these objects, and others which will become apparent hereafter, one feature of the present invention resides, in a sweeping device of the above-discussed type, in the mounting of the corner-sweeping brush in the front region of the housing of the floor-sweeping device as considered in the direction of movement thereof away from the user, and for rotation about an axis. An arrangement is provided for rotating the corner-sweeping brush, which arrangement preferably includes one element rigidly connected with the corner-sweeping brush for shared rotation about the axis of the latter, and another element which is mounted in the housing of the sweeping device for translation between a retracted position and an extended position, and operative for engaging the first-mentioned element during the translation of the other element. An actuating member causes the translation of the other element between the retracted and the extended positions thereof when the front region of the sweeping device reaches an obstruction on a surface being swept, so that the two elements engage one another and cause the corner-sweeping brush to rotate, whereby dirt is removed from the vicinity of the obstruction. The actuating member projects out of the housing of the sweeping device, and is either connected to the handle of the sweeping device, or is independent therefrom and extends either forwardly or upwardly out of the housing. In any event, the actuating member is mounted in the housing for movement in the direction of translation of the other element.

As a result of this particular arrangement of the drive for rotating the corner-sweeping brush, it is possible to rotate the corner-sweeping brush even after the housing of the sweeping device has come to a complete standstill upon contracting an obstruction, even though such a corner-sweeping brush would not be otherwise rotating if it were driven by the afore-mentioned wheels. Consequently, provided that the corner-sweeping brush or a plurality of such brushes is so arranged that it reaches forwardly of the housing of the sweeping device, or at least that it is flush with the front surface of the housing, it is possible to sweep the region of the floor immediately adjacent to the obstruction, such a region being henceforth called a corner region. As a result of this, such a corner region can be effectively swept, and the dirt present in such a region can be at least forwarded to the above-mentioned main brush to be picked up by the same and deposited into the dirt-collecting receptacle. Thus, such a sweeping device equipped with the independently driven corner-sweeping brush or brushes is particularly suited for removing dirt from otherwise inaccesible corner regions of the floor, having all the advantages of the conventional sweeping devices as far as removing dirt from other regions of the floor is concerned, but being also operative in the corner regions which were heretofore either totally inaccessible or accessible only to a limited extent to the conventional sweeping devices.

In one currently preferred embodiment of the invention, the translation element is mounted in the housing of the sweeping device for movement in the direction of advancement of the latter and tangentially of the rotating element of the arrangement for rotating the corner-sweeping brush, which is connected thereto and coaxial therewith. As a result of this arrangement, it is possible to utilize the force which is in any event exerted by the user of the sweeping device on the same in the advancement direction thereof for driving the corner-sweeping brush into rotation, even though the driving action is accomplished independently of the rotation of the wheels which support the housing. In order to achieve transmission of the force and energy, which is applied by the actuating member to the translation element to the corner-sweeping brush with only a minimum amount of losses, it is proposed according to a further feature of the present invention to construct the rotating element of the arrangement for rotating the brush as a circumferentially toothed pinion, and the translation element as a toothed rack.

It is further advantageous according to a further currently preferred embodiment of the present invention to mount the translation element on a thrust rod which extends in the direction of movement of the translation element so as to permit relative displacement between the thrust rod and the translation element in such direction, and to form the translation element with an internal chamber. In this case, a compression spring may be located in the chamber, surrounding the thrust rod and connected at one of its ends, while the other end of the spring engages the translation element. Preferably, the leading end of the spring in the direction of movement of the translation element abuts against a foward transverse wall of the translation element, while the trailing end abuts against a projection of the thrust rod. In this manner, a storage unit is incorporated into the drive for rotating the corner-sweeping brush, which stores the force exerted by the user of the sweeping device and releases the same at a later time. This is due to the fact that the corner-sweeping brush, which is in contact with the surface being swept, is subject to frictional and inertial retardation forces which attempt to prevent the brush from rotating, so that a certain threshold force must be exerted on the brush before it commences its rotation. Thus, the reaction of the corner-sweeping brush to the displacement of the thrust rod is not immediate, but rather a time delay occurs during which the spring is compressed and energy stored therein which is subsequently released with attendant rotation of the brush, even after the forward movement of the housing of the sweeping device, and also that of the thrust rod, have been terminated.

It is also proposed, in accordance with a further currently preferred embodiment of the present invention, to provide a control member for controlling the forward movement of the translation element, and particularly for controlling the commencement of the forward movement thereof. Preferably, the control member is constructed as a pawl which has one projection engaging a forwardly facing shoulder of the translation element, and another projection which extends into a recess or slot formed in a lateral wall of the translation element. A further modification of this aspect of the present invention involves the predetermination of the time-delay period, in that the pawl is so configurated that the translation element is arrested in its retracted position until all or at least a substantial part of the available energy has been stored in the spring, depending on the particular configuration of the pawl. Thus, if so desired, the energy available for driving or rotating the corner-sweeping brush can be stored in its entirety in the compression spring, and released only after the sweeping device has completely ceased to move, and the thrust rod has reached its final position. In this manner, the available energy is stored until the corner-sweeping brush is in its final position, in which it has entered to the greatest extent possible into the corner region, and only then the stored energy is fully utilized for rotating the corner-sweeping brush and thus for effectively removing the dirt from the corner region of the floor.

In the currently preferred embodiment of the present invention which utilizes the concept of storing most or all of the available energy in the compression spring in the chamber or the translation element, the translation element is formed with a slot which communicates the chamber with the exterior of the translation element, and the projection of the pawl which is received in the slot extends into the chamber and into the path of movement of the projection of the thrust rod against which the compression spring abuts. Preferably, the projection of the pawl which extends into the chamber is formed with an inclined rear surface which comes into contact with the projection of the thrust rod as the latter moves toward its final position, so that subsequently the projection of the thrust rod, as the same advances further, displaces the pawl laterally of the translation element so that the other projection of the pawl which has heretofore engaged the forwardly facing shoulder of the translation element disengages from the same and the translation element is thus automatically released and commences its forward movement into engagement with the pinion, forcing the same to rotate. It is to be understood that the location of the inclined surface of the pawl with respect to the translation member, and the inclination thereof, may be so selected as to predetermine the extent of movement of the thrust member before the translation element is released, and thus to indirectly predetermine the amount of energy stored in the spring prior to such release.

A high degree of reliability of function of the control member, and simultaneously a simple construction thereof, result in a currently preferred embodiment of the invention when the control member is mounted in the housing of the sweeping device for pivoting movement in a plane which extends into the path of movement of the translation element, and when a spring is provided which urges the control member toward the translation element. It is also currently preferred that the control member be located at a side of the translation element which faces away from the rotating element of the arrangement for rotating the corner-sweeping brush.

In order to insure that the thrust rod and the arrangement for rotating the corner-sweeping brush are returned into their initial positions after the termination of the corner-sweeping operation, there is preferably provided a return spring which is located outside the immediate region of the translation element and which extends between the thrust rod and a wall portion of the housing and urges the thrust rod and, consequently, the elements immediately or indirectly connected thereto, toward their initial positions.

In a particularly advantageous embodiment of the present invention, the thrust rod is rigidly connected with a mounting support for a handle of the sweeping device, which mounting support is mounted in the housing of the sweeping device for a limited displacement in the direction of advancement of the sweeping device and thus of the thrust rod. In this manner, it is achieved that, when the sweeping device comes to a sudden stop upon abutting against an obstruction, the continuing movement of the handle and thus of the mounting support thereof in the forward direction of the sweeping device results in a corresponding movement of the thrust rod and, eventually, in a movement of the translation member into driving engagement with the rotating element of the drive for the corner-sweeping brush, which movement is terminated only after the thrust rod has reached its final position.

However, it is also possible, in a modified embodiment of the present invention, to so arrange the thrust rod associated with the particular corner-sweeping brush that it projects frontwardly of the sweeping device, and to possibly provide the projecting end of the thrust rod with an enlarged head portion. In this modified embodiment, the thrust rod will be displaced toward its final position even before the housing proper of the sweeping device has reached its final position adjacent the obstruction. It will be appreciated that the time-delay feature of the present invention is particularly important in this modified embodiment. In all other respects, the configuration and function of the drive for driving the corner-sweeping brush are identical with the above-discussed embodiment, except that the thrust rod remains stationary and the rest of the sweeping device moves with respect to the thrust rod.

According to a further modified embodiment of the present invention, it is also possible to construct the drive for rotating the corner-sweeping brush as a worm gear assembly, wherein a rotating element is associated with the corner-sweeping brush, and the translation element is coaxial with the rotating element. In this embodiment, the thrust rod may extend upwardly of the housing of the sweeping device so that, after the sweeping device has reached its final position next to the obstruction, the thrust rod may be actuated by the user of the sweeping device, either manually or by stepping on the free end of the thrust rod which may again be provided with an enlarged head portion. In a currently preferred embodiment of this modification, the main axes of the drive elements coincide with the axis of rotation of the corner-sweeping brush, forming extensions thereof, which results in a particularly simple construction of the drive. While it is currently preferred that the thrust rod itself extends upwardly of the housing, it is also possible to have separate actuating means, in which event the thrust rod may be fully accommodated within the housing. In order to assure proper and reliable functioning of the drive, it is further proposed that the translation element of this drive be provided with a guiding projection, and that the housing of the sweeping device be provided with a guiding channel receiving the guiding projection of the translation element, and to provide a compression spring between the housing and the translation element which urges the latter toward its initial position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
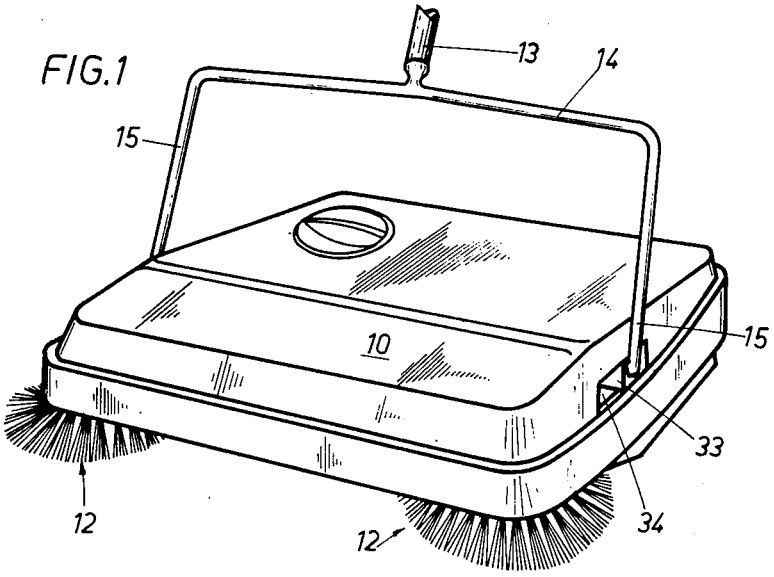
FIG. 1 is a perspective view of a floor-sweeping device having two corner-sweeping brushes driven in accordance with the present invention.

Referring now to the drawings, and first to FIG. 1 thereof, it may be seen therein that the drive according to the present invention is to be used in an otherwise conventional floor-sweeping device which includes a housing 10, in which there is mounted, in a conventional manner, a brush roller or a plurality of such brush rollers which are well known and thus have not been illustrated. It suffices to say that such rollers pick up the dirt from the surface being swept, and that they deposit the dirt into one or more receptacles in the housing. The brush rollers may be driven into rotation by means of wheels which engage the surface being swept and whose movement, as the housing 10 is displaced, is transmitted to the brush rollers. These wheels are also conventional so that they also need not be illustrated.

In addition thereto, the otherwise conventional sweeping device is equipped with corner-sweeping brushes 12, which in the illustrated example are cup-shaped and the bristles thereof extend forwardly and laterally beyond the circumference of the housing 10. Of course, the brushes 12 could also be configurated as brush rollers mounted for rotation about a horizontal axis. The purpose of the corner-sweeping brushes 12 is to remove the dirt from the regions of the surface being swept which are not accessible to the main brushes or brush rollers, and to forward the dirt into a collecting receptacle either directly or indirectly by forwarding the dirt into regions spaced from the corner regions to which the main brushes have access and from which they are capable of picking up the dirt and of forwarding the same into the collecting receptacle. It is to be understood that the present invention is not limited to the type of corner-sweeping brushes which is shown in the drawing, or to the particular described operation thereof.

The sweeping device is provided with a handle 13 which has a free end portion to be grasped by the user of the device, and a bifurcated end portion 14 having two extensions 15 which embrace the housing 10. Push-pull movements transmitted to this handle 13 by a user result in corresponding movements of the housing 10.

The extensions 15 have end portions which extend at angles to the extensions 15 and reach into the housing 10 where they are pivoted for movement about an axis which extends transversely of the housing 10.

Figure 2:
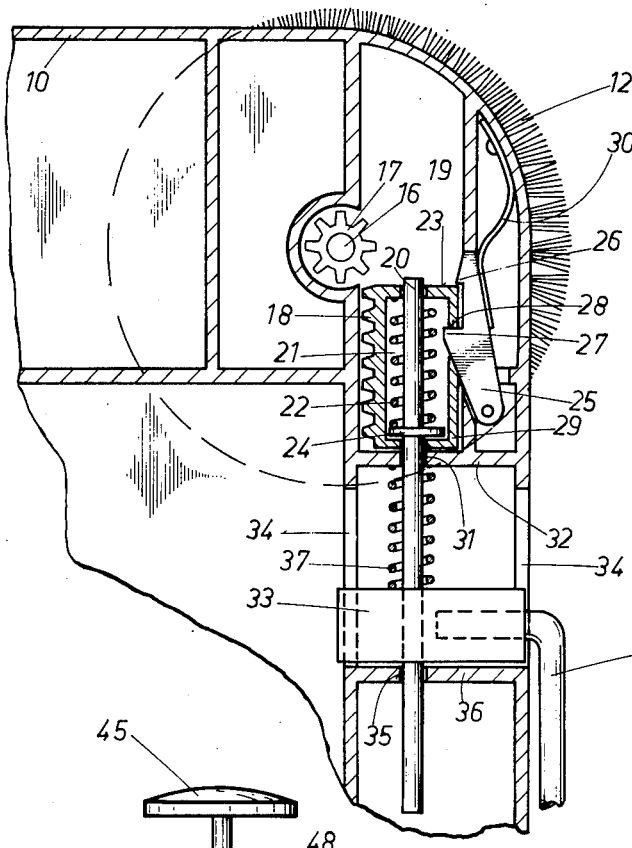
FIG. 2 is a partial cross-sectional view of a first embodiment of the drive for the corner-sweeping brush according to the invention.

Having so described the general environment in which the drive for the corner-sweeping brush 12 is utilized, attention will now be directed to the embodiment of the present invention illustrated in FIG. 2. It is to be noted that the corner-sweeping brush 12 of this embodiment is mounted in the housing 10 for rotation about an upright shaft 16, that is a shaft having an axis which extends substantially normal to the surface being swept, so that the cup-shaped bristle annulus of the brush 12 contacts the surface being swept in its front region. A rotating element, shown as a pinion 17, is rigidly connected to the shaft 16 to share its rotation about its axis, and the pinion 17 constitutes one part of the drive for rotating the corner-sweeping brush 12 independently of the movement of the aforementioned wheels. A translation element, configurated as a toothed rack 18, is located adjacent to the pinion 17 which is rigidly connected to the brush 12, and constitutes another part of the drive. The sweeping device housing 10 is formed with a guide 19 which extends in the direction of advancement of the housing 10, and the translation element 18 is mounted in the guide 19 for movement longitudinally thereof between a retracted position and an extended position. A thrust rod 20 extends longitudinally of the guide 19 and through the translation element 18, and is mounted in the housing 10 for movement in the same direction as, but independently of, the translation element 18, so that the translation element 18 may assume different positions with respect to the thrust rod 20.

The translation element 18 is formed with a chamber 21, and a compression spring 22 is accommodated in the chamber 21, surrounding the thrust rod 20. The translation element 18 is further formed with a front transverse wall 23, and the thrust rod 20 is provided with a flange-shaped projection 24, and the spring 22 extends between and abuts the front transverse wall 23, on the one hand, and the projection 24, urging the same away from one another.

A control member 25 is mounted in the housing 10 for pivoting movement in a plane which extends into the guide 19 and longitudinally thereof. The control member 25 is located to a side of the translation element 18 which faces away from the rotating element 17, that is to a side of the element 18 which is not provided with the teeth. The control member 25 includes an arresting projection 26 which, when the translation element 18 is in its initial or retracted position shown in the drawing, engages the adjacent front region of the transverse wall 23 of the translation element 18, so that it prevents the translation element 18 from moving toward its extended position. In addition thereto, the control member 25 is provided with another projection 27 which reaches into a slot 28 provided in the adjacent lateral wall 29 of the translation element 18, and extends into the chamber 21 and into the path of movement of the flange-shaped projection 24 of the thrust rod 20. A spring 30 presses against the control member 25 and urges the same in the direction or engagement thereof with the translation element 18, that is toward the position illustrated in FIG. 2.

Rearwardly of the translation element 18 when considered in direction of movement thereof toward the extended position, the thrust rod 20 extends through an opening 31 formed in a transverse wall 32 of the housing 10 which limits the guide 19 and thus determines the retracted position of the translation element 18, and is rigidly connected with a mounting support 33 to which the bifurcated portion 14 of the handle 13 is in turn connected. The mounting support 33 is in turn mounted in wall openings 34 of the housing 10 of the sweeping device for sliding movement therein. In the illustrated embodiment, the thrust rod 20 extends beyond the mounting support 33 and through a guide opening 35 provided in an additional transverse wall 36 of the housing 10. Finally, it is to be mentioned that the mounting support 33, and thus the thrust rod 20, are acted upon by a return spring 37, which urges the thrust rod 20 and the other parts which are directly or indirectly connected thereto, toward their initial positions.

When the sweeping device reaches an obstruction during its forward movement, so that the front region of the housing 10 contacts the obstruction, the further progress of the sweeping device terminates. However, at the same time, due to the mounting of the mounting support 33 in the wall openings 34 for sliding movement therein in the direction of advancement of the sweeping device, and due to the fact that a force is still exerted by the user of the sweeping device on the handle 13 and thus on the mounting support 33, the latter is displaced from its initial position toward the front region of the housing 10. When the bifurcated end portion 14 of the handle 13, and thus the mounting support 33 in which the latter is mounted for pivoting movement about an axis, are displaced forwardly of the housing 10, the thrust rod 20 is displaced in the same direction, that is forwardly of the housing 10; initially, the translation element 18 remains stationary, so that the thrust rod 20 is displaced relative to the translation element 18 and the spring 22 is compressed. However, as soon as the projection 24 of the thrust rod 20 comes into contact with the projection 27 of the control member 25, the latter is displaced outwardly against the action of the spring 30, so that eventually the projection 26 of the control member 25 is displaced to such an extent that it releases the translation element 18. Thus, the displacement of the translation element 18 follows that of the thrust rod 20 only after a certain, predetermined period of time, so that the thrust rod 20 with its projection 24, the translation member 18, the spring 30 and the control member 25 form a time-delay unit.

Once the translation element 18 is released, engagement is established between the same and the pinion 17, and the further movement of the translation element 18 toward its extended position results in the rotation of the pinion 17 and thus of the corner-sweeping brush 12. The extent of the displacement of the thrust rod 20 is limited by the length of the wall openings 34 for the mounting support 33 connected to the bifurcated portion 14 of the handle 13, so that the extent of movement of the translation element 18 is similarly limited to movement between an initial, or retracted position, and a final, or extended position. Since the forward or front portion of the corner-sweeping brush 12 contacts the surface being swept, the rotation of the brush 12 results in removal of the dirt from the corner region adjacent to the obstruction and in forwarding of the same toward the rear of the sweeping device, that is either into a separate dirt-collecting receptacle (not shown), or toward the main brush (also not shown) which picks up the dirt forwarded to it by the action of the corner-sweeping brush 12 and deposits it into a dirt-collecting receptacle associated with the main brush and well known in the art.

Figure 3:
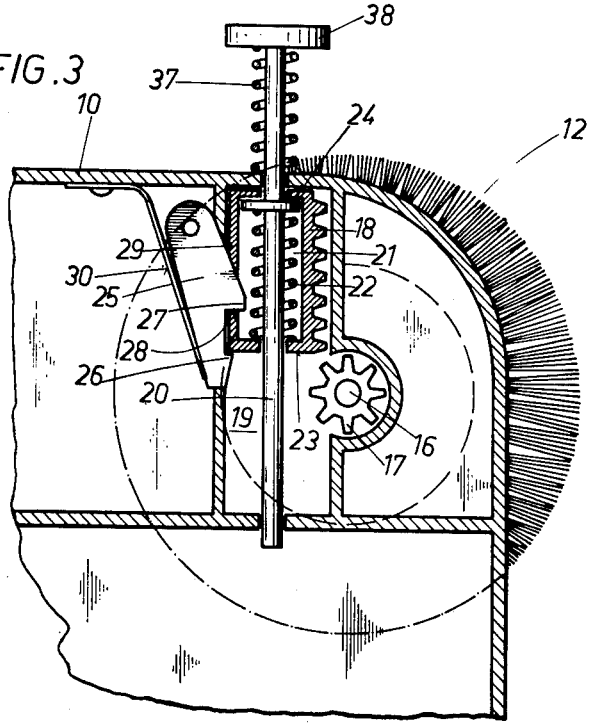
FIG. 3 is a partial cross-sectional view of a second embodiment of the drive for the corner-sweeping brush according to the invention.

The embodiment of the present invention which is illustrated in FIG. 3 is in many respects similar to that discussed previously, and thus the same reference numerals have been used to designate corresponding parts of this embodiment. The main difference between this and the previous embodiment resides in the fact that the thrust rod 20 is not connected to the handle 13 of the sweeping device, but rather projects frontwardly out of the housing 10. The free end portion of the thrust rod is provided with an enlarged head portion 38. Also, the arrangement of the thrust rod 20 and of the translation element 18 is so changed with respect to the previously discussed embodiment that the associated parts are rotated with respect to the pinion 17 by 180° about a vertical axis.

In this embodiment of the present invention, the thrust rod 20, when the housing 10 of the sweeping device approaches an obstruction so that the head portion 38 abuts the same, is displaced relative to the housing 10 against the action of a return spring 37 and also against the action of the spring 22 toward the rear of the housing 10. As a matter of fact, relative to the environment, the movement of the thrust rod 20 is arrested while the housing 10 of the sweeping device continues its forward movement, but the result is the same as in the housing 10 were stationary and the thrust rod 20 moved with respect thereto. As soon as the projection 24 of the thrust rod 20, which also serves as an abutment for the spring 22 accommodated in the chamber 21 of the translation element 18, contacts the projection 27 of the control member 25 which extends into the chamber 21 and into the path of movement of the projection 24, the control member 25 is displaced outwardly with respect to the translation element 18 against the action of the spring 30 and into an inactive position. As soon as the control member 25 releases the translation element 18, and from then on, the latter commences its displacement in the direction of the displacement of the thrust rod 20 and toward its extended position as a result of the action of the spring 22 which had previously accumulated energy therein. The displacement of the translation element 22 again follows that of the thrust rod 20 after a time delay which depends on the particular construction of the time-delay unit encompassing the spring 22, the control member 25, the translation element 18 and the thrust rod 20. Following the release of the translation element 18, the latter engages the pinion 17 and subsequently drives the same and thus the corner-sweeping brush 12 into rotation, so that dirt is forwarded from the corner region adjacent the obstruction toward the center of the sweeping device.

Figure 4:
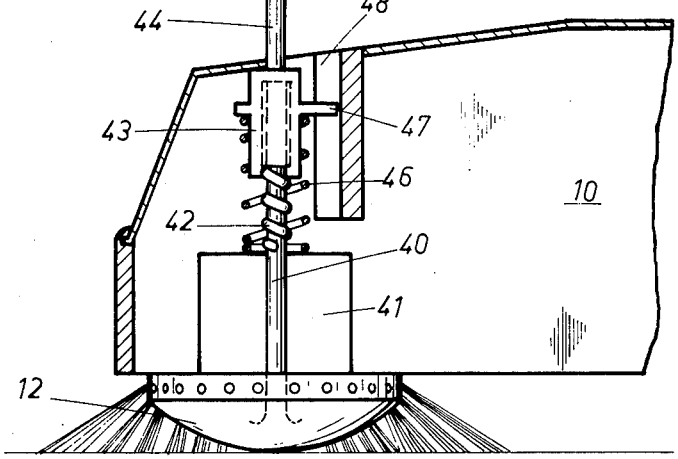
FIG. 4 is a partial cross-sectional view of a third embodiment of the drive for the corner-sweeping brush according to the invention.

A further embodiment of the present invention is illustrated in FIG. 4. In this embodiment, the actuation of the corner-sweeping brush 12 is independent of the respective position of the sweeping device, that is, the corner-sweeping brush can be actuated irrespective of whether or not an obstruction has been encountered. Thus, while the brush 12 will be mostly actuated only in the corner regions of the surface being swept, it can also be actuated in other regions of the surface, such as excessively soiled regions of the surface. In this embodiment, the brush 12 is mounted in the housing 10 of the sweeping device for rotation about an upright shaft 40, that is a shaft whose axis again extends substantially normal to the surface being swept. The shaft 40 is supported in a bearing block 41, and it is rigidly connected with a driving spindle 42 upwardly of the bearing block 41. A driving nut 43 is mounted in the housing 10 for translation coaxially with the spindle 42. In this embodiment, the spindle 42 constitutes the rotating element, and the nut 43 the translation element, of the drive for the brush 12.

The nut 43 is formed with an extension 44 which projects upwardly out of the housing 10, and an enlarged head portion 45 is provided on the extension 44 and of the housing 10. A return spring 46 acts on the nut 43, urging the same toward the position illustrated in FIG. 3, and the housing 10 is formed with a guide slot 48 into which a guide projection 47 of the nut 43 projects, the cooperation of the projection 47 with the slots 48 resulting in only translational movement of the nut 43, without any rotation thereof. The spindle 42 and the nut 43 are formed with complementary worm gears. Of course, the nut 43 could also be connected to the shaft 50, and the spindle 40, and the spindle 42 to the extension 44, without any change in the overall design and operation of the drive for the brush 12.

When the brush 12 is to be actuated, for instance in a corner region of the surface being swept, the extension 44 is displaced downwardly, for instance by the user's stepping on the enlarged portion 45, so that the nut 43 (or the spindle 42, as the case may be), is also displaced downwardly, so that the complementary gears of the spindle 42 and of the nut 43 engage one another and cause the shaft 40 of the brush 12 to rotate. As a result of the direct connection of the spindle 42 (or the nut 43) with the shaft 40, the brush 12 can be rotated independently of the movement of the sweeping device, that is even if the latter is stationary.

As already mentioned, the above-discussed embodiments are only illustrative of the concept of the present invention, and the latter is not limited to the discussed and illustrated embodiments. So, for instance, the brush 12 may be of a different configuration and/or arrangement in the housing 10, in which a similar drive arrangement may be utilized after being modified to comply with the particular requirements. Also, the time-delay feature may be omitted, in which case the translation element 18 will be directly connected to or of one piece with the thrust rod 20. In addition thereto, other arrangements may be provided for driving the brush 12 also during the normal operation of the sweeping device, that is outside of the corner regions of the surface being swept, and for discontinuing the operation of such driving arrangements when the sweeping device reaches a corner region, at which time the drive according to the present invention takes over.

It will be understood that each of the elements described above, or two or more together, may also find a useful application in other types of sweeping devices differing from the types described above.

While the invention has been illustrated and described as embodied in a sweeping device for sweeping floors, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a sweeping device of the character described, a combination comprising a housing having a front region; at least one corner-sweeping brush mounted in said front region for rotation about an axis; means for rotating said brush about said axis, including a rotating element connected to said brush, and a translation element formed with a chamber and mounted in said housing for translation between a retracted position and an extended position, and operative for engaging said rotating element and for rotating the latter during said translation; means for actuating said rotating means at least when said front region reaches an obstruction on a surface being swept so that said brush rotates, whereby dirt is removed from the vicinity of said obstruction, said actuation means including an elongated thrust rod mounted in said housing for displacement in a direction coinciding with the translation of said translation element and extending through said chamber, said thrust rod being formed with a projection accommodated in said chamber, and a spring in said chamber surrounding said thrust rod and abutting against said projection and said translation element and urging the latter away from the former longitudinally of said thrust rod and toward said rotating element.

2. A combination as defined in claim 1, wherein said translation element is provided with a shoulder in a front region thereof and with a slot in a lateral region thereof when considered in the direction of translation of the translation element; and further comprising a control member having a first projection engaging said shoulder and a second projection received in said slot.

3. A combination as defined in claim 2, wherein said second projection of said control member extends through said slot and into said chamber and into a path of displacement of said projection of said thrust rod relative to said translation element; and wherein said second projection of said control member is formed with an inclined surface which is engaged by said projection of said thrust rod during its displacement relative to said translation element.

4. A combination as defined in claim 2, wherein said control member is mounted in said housing for pivoting about an axis and in a plane traversing said translation element; and further comprising a spring urging said control member toward said translation element.

5. A combination as defined in claim 4, wherein said control member and said rotating element are situated to opposite sides of a path in which said translation element translates between said retracted and said extended positions thereof.

6. In a sweeping device for removing dirt from surfaces, a combination comprising a housing having a front region; removing means in said housing for removing and collecting dirt from a surface as said housing moves thereover; means for forwarding dirt from the vicinity of said front region of said housing toward said removing means, including at least one corner-sweeping brush mounted in said housing for rotation about an upright axis and having bristles which contact the surface at said front region; and means for rotating said corner-sweeping brush, when said housing is stationary relative to the surface, including a rotating element connected to said corner-sweeping brush for shared rotation therewith about said upright axis, a translation element mounted in said housing for translation between a retracted position and an extended position, and operative for engaging and rotating said rotating element during said translation, and a thrust member mounted in said housing for displacement in a direction coinciding with that of said translation, and operative for translating said translation element between said positions thereof in response to displacement of said thrust member in said direction.

7. A combination as defined in claim 6; wherein said rotating means further includes a mounting support mounted in said housing for displacement in the direction of movement of the latter and connected to said thrust member; and wherein said sweeping device comprises a handle which is pivotably connected to said mounting support and operative for displacing the same forwardly when said front region of said housing reaches and obstruction.

8. A combination as defined in claim 7, wherein said thrust member has a free end projection forwardly out of said housing and operative for actuating said rotating means.

9. A combination as defined in claim 8, and wherein said free end is formed with an enlarged head portion.

10. A combination as defined in claim 6, wherein said rotating and translation elements have meshing worm gears; and wherein said translation element is coaxial with said rotating element.

11. A combination as defined in claim 6, wherein said translation element is mounted in said housing for translation in the direction of movement of the sweeping device; wherein said rotating element is coaxial with said brush; and wherein said translation element translates tangentially of said rotating element.

12. A combination as defined in claim 11, wherein said rotating element is a circumferentially toothed pinion; and wherein said translation element has a toothed rack portion engaging said pinion at least during said translation of said translation element.

13. A combination as defined in claim 6, wherein said thrust member is elongated and formed with a projection; and further comprising a spring surrounding said thrust member and abutting against said projection and said translation element and urging the latter away from the former longitudinally of said thrust member and toward said rotating element.

14. A combination as defined in claim 6; and further comprising a return spring abutting against said housing and against said thrust member and urging the latter toward an initial position thereof.

15. A combination as defined in claim 6, wherein said translation element and said rotating element are coaxial with said brush.

16. A combination as defined in claim 6, wherein said thrust member has a free end projection upwardly out of said housing.

17. A combination as defined in claim 16, wherein said free end is formed with an enlarged head portion.

18. A combination as defined in claim 6, wherein said housing is formed with an elongated guide extending parallel to said axis of said brush; and wherein said translation element is formed with a guide projection received in said guide and displaceable longitudinally of said guide.

* * * * *